US005899407A

United States Patent [19]

Hall, III

[11] Patent Number: 5,899,407

[45] Date of Patent: May 4, 1999

[54] SECURED DISPENSER FOR ROLLED MATERIAL

[76] Inventor: Joseph S. Hall, III, P.O. Box 74121, New Orleans, La. 70174-1313

[21] Appl. No.: 09/134,123

[22] Filed: Aug. 14, 1998

[51] Int. Cl.[6] ..... B65H 16/06

[52] U.S. Cl. ..... 242/598.3; 242/598.5; 242/599.3

[58] Field of Search ..... 242/596, 596.4, 242/596.7, 596.8, 598, 598.3, 598.5, 599, 599.2, 599.3

[56] References Cited

U.S. PATENT DOCUMENTS

| | | | |
|---|---|---|---|
| 710,034 | 9/1902 | Belknap | 242/598.5 |
| 1,202,190 | 10/1916 | Kern | 242/598.5 |
| 2,215,053 | 9/1940 | Reese | 242/598.3 |
| 2,244,804 | 6/1941 | Robinson | 242/598.5 |
| 3,069,105 | 12/1962 | Press et al. | 242/598 |
| 3,319,855 | 5/1967 | Tucker et al. | 242/597.8 |
| 4,522,348 | 6/1985 | Strout et al. | 242/599.3 |
| 4,848,690 | 7/1989 | Lemoine | 242/598.5 |
| 4,915,316 | 4/1990 | Bastian | 242/596.8 |
| 5,662,288 | 9/1997 | Chiang | 242/596.8 |

FOREIGN PATENT DOCUMENTS

| | | | |
|---|---|---|---|
| 1 549 604 | 8/1979 | United Kingdom | 242/598.3 |

*Primary Examiner*—John P. Darling
*Attorney, Agent, or Firm*—Michael D. Carbo; Jacqueline M. Daspit

[57] ABSTRACT

A "U" shaped dispenser which is comprised of a base, two arms projecting from the base, and an axial rod for insertion through openings in the arms. Each arm has a side projection, or ear, that surrounds the opening and that is parallel to the base. The ears are inserted into the interior cavity of the rolled material. The rod is inserted through the interior cavity of the rolled material and locked into place by mating grooves on the rod with slots in the openings in the arms, thereby securing the rolled material into position. By pulling on the exposed end of the rolled material, a desired amount of material can be removed with one hand.

Preferably, the arms are connected to the base as a single unit. The dispenser is made, preferably, of a sufficiently flexible material which allows for the arms to swing out when unfolded from the packaging material. Alternatively, the dispenser is made of a less flexible material and hinges are used to maintain flexibility.

6 Claims, 2 Drawing Sheets

SECURED DISPENSER FOR ROLLED MATERIAL

BACKGROUND OF THE INVENTION

The present invention relates to a secured dispenser for rolled material such as paper towels or toilet tissue, and more particularly, a secured dispenser incorporating an axial rod which is inserted through openings in the arms of the dispenser and through the interior cavity of the rolled material, such that the rolled material may be locked into place without inhibiting dispensing of the rolled material.

The present invention relates to rolled materials which utilize an interior cavity around which the material is rolled. Some examples of such rolled materials, include paper towels or toilet tissue which utilize a cardboard center as the interior cavity.

There are many devices for dispensing and holding rolled materials such as paper towels or toilet tissue. It is common for many of these devices to incorporate an axial rod which is inserted through an opening, or indentation, in at least one end of the dispenser and through the rolled material being dispensed. A problem with known dispensers is that the rod becomes loose and thus the rolled material does not stay in place in the dispenser.

There are other dispensers which incorporate tension to aid in maintaining the rolled material in place between the arms of the dispenser. A problem with the frequent use of this type of known dispenser is that the arms become worn and lose their tension capability. The result is that the rolled material continually falls from the dispenser onto a countertop or the floor.

Another problem solved by the present invention is the ability of "one-hand" usage. With the known dispensers, a user is required to use both hands to pull off any of the rolled material. For example, one hand would hold the edge of the material which is being dispensed and the other hand would hold the material in place so that only a single or two sheets would come off instead of many sheets or the entire material becoming unrolled with the pull of one hand.

It is an object of the present invention to provide a rolled material dispenser having an axial rod which locks the rolled material in place until manually unlocked by the user but which does not inhibit dispensing of the rolled material. It is a further object of the present invention to provide a rolled material dispenser which allows for one hand operation. These, and additional objects, advantages, features, and benefits of the present invention will become apparent from the following description of a preferred embodiment of the present invention.

BRIEFS SUMMARY OF THE INVENTION

The present invention is a "U" shaped dispenser which is comprised of a base, two arms projecting from the base, and an axial rod for insertion through openings in the arms. Each arm has a side projection, or ear, that surrounds the opening and that is parallel to the base. The ears are inserted into the interior cavity of the rolled material. The rod is inserted through the interior cavity of the rolled material and locked into place by mating grooves on the rod with slots in the openings in the arms, thereby securing the rolled material into position. By pulling on the exposed end of the rolled material, a desired amount of material can be removed with one hand.

Preferably, the arms are connected to the base as a single unit. The dispenser is made, preferably, of a sufficiently flexible material which allows for the arms to swing out when unfolded from the packaging material. Alternatively, the dispenser is made of a less flexible material and hinges are used to maintain flexibility.

BRIEF DESCRIPTION OF THE SEVERAL VIEWS OF THE DRAWINGS

The present invention is further described in connection with the accompanying drawings in which.

DETAILED DESCRIPTION OF THE INVENTION

The present invention is a dispenser for rolled materials. Dispenser 1 holds and dispenses rolled material 2, such as paper towels or toilet tissue. Rolled material 2 commonly utilizes an interior axial cavity around which the material is rolled. The interior axial cavity (not shown) of rolled material 2 may be supported by cardboard rolls, as is the case for paper towels or toilet tissue.

Figure 1:
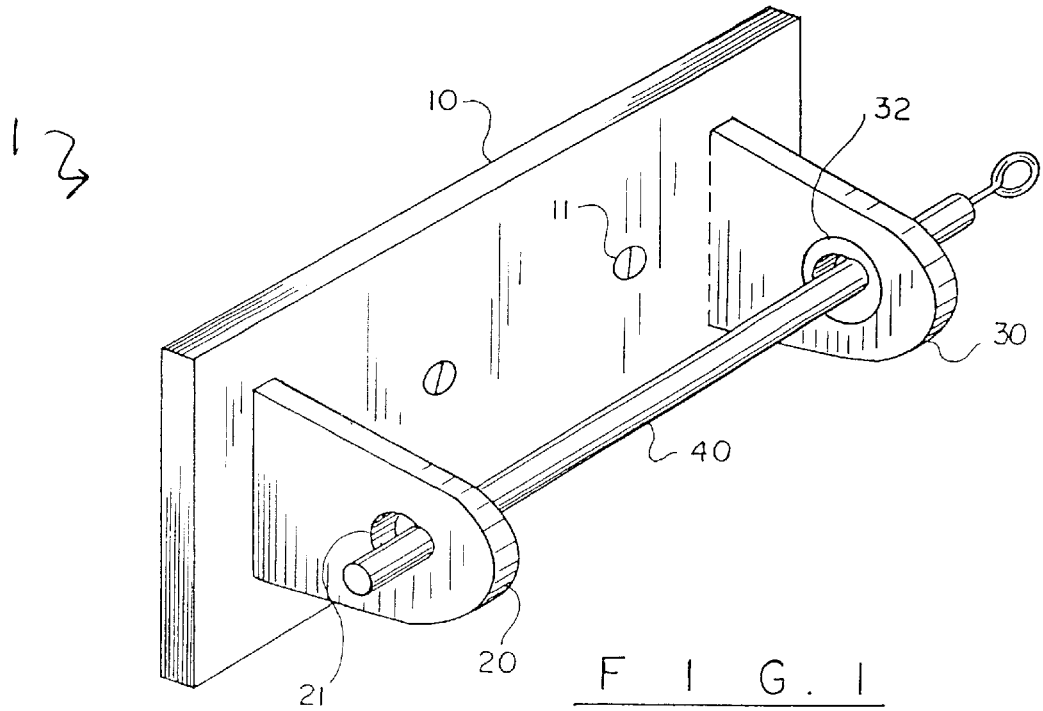
FIG. 1 is an overhead perspective view of an embodiment of the present invention.
Figure 2:
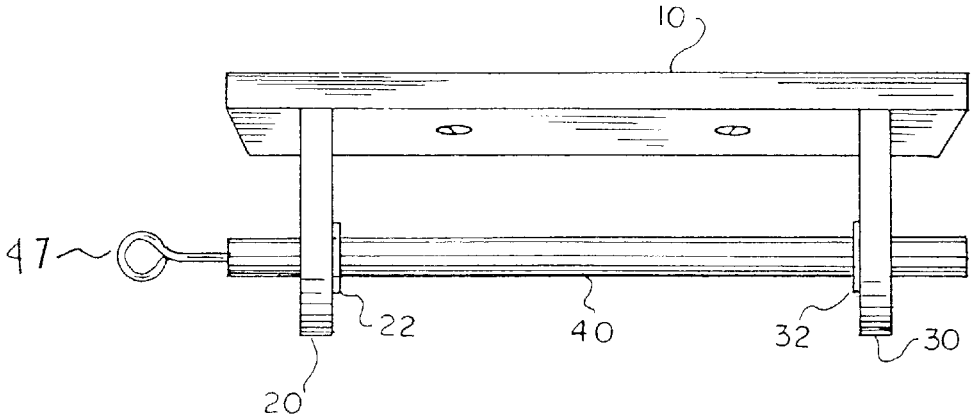
FIG. 2 is an overhead view of an embodiment of the present invention.
Figure 6:
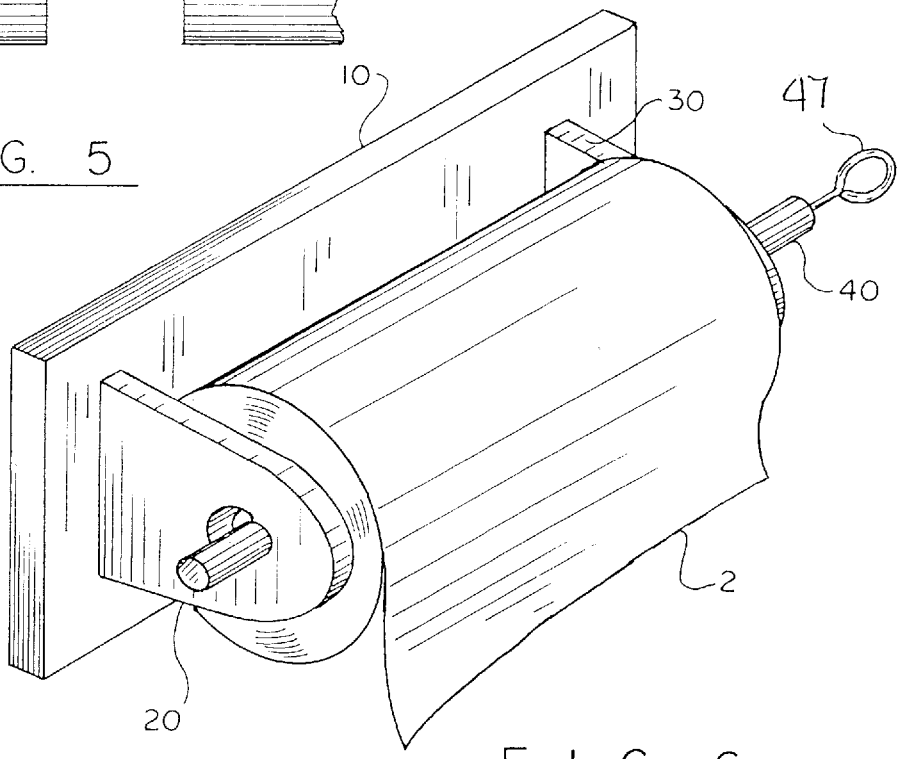
FIG. 6 is an overhead perspective view of an embodiment of the present invention attached to a vertical surface and with paper towels in place.

A preferred embodiment of dispenser 1 is shown in FIG. 1, which illustrates dispenser 1 without rolled material 2. FIG. 6 illustrates dispenser 1 with rolled material 2. Dispenser 1 may be attached a vertical surface through any type of manner as is known. For example, base 10 can be attached to a horizontal or vertical surface through screws 11 inserted through holes 12 in base 10 and into the surface of the horizontal or vertical surface. (See FIGS. 1 and 3.)

Dispenser 1 is formed by base 10 having a first arm 20 and a second arm 30 which are perpendicular, or at a 90 degree position, to base 10. Additionally, a rod 40 is adapted for insertion into opening 21 of first arm 20 and opening 31 of second arm 30 of dispenser 1. As shown in FIG. 1, arm 20 has opening 21 with a side projection, or ear, 22 through which rod 40 is inserted. Likewise, arm 30 has opening 31 with a side projection, or ear, 32 through which rod 40 is inserted. Side projections, or ears, 22 and 32 are smaller in diameter than the interior axial cavity (not shown) of rolled material 2. Alternatively, side projections, or ears, 22 and 32 are of a size sufficient to stabilize rolled material 2 and to keep rolled material 2 from rotating without the exertion of force. It should be noted that arm 20 and arm 30 are mirror images of each other.

Figure 3:
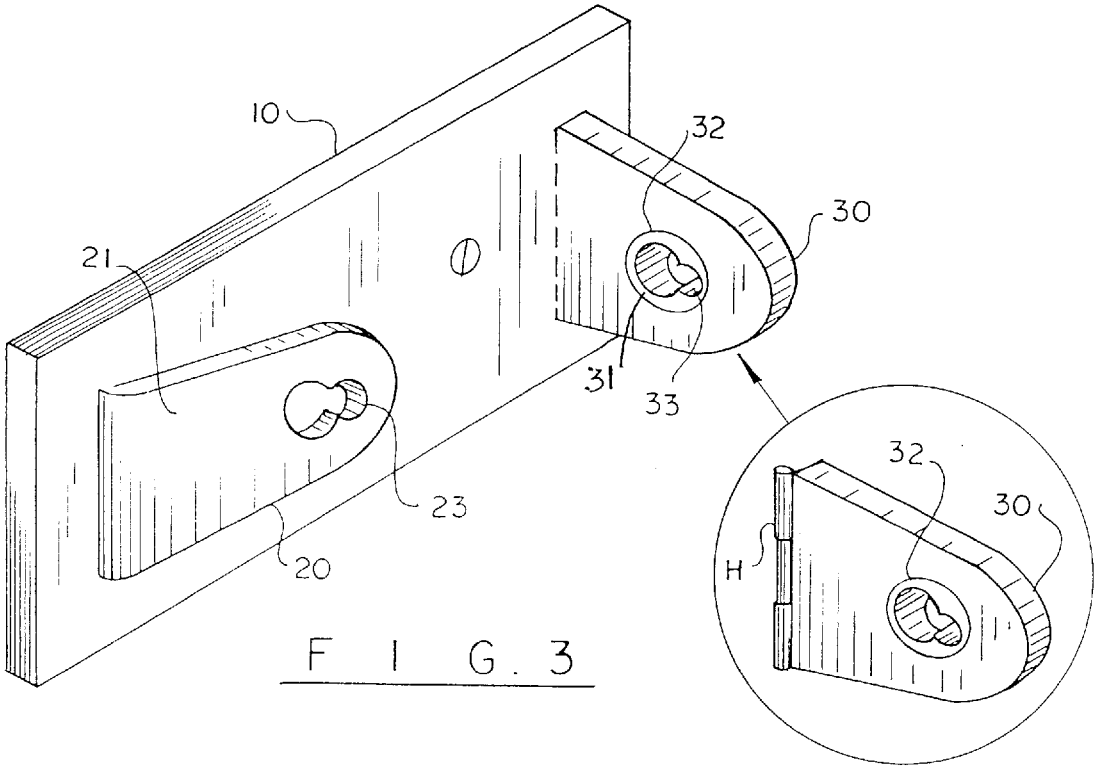
FIG. 3 is a perspective view of an embodiment of the present invention detailing the collapsible arm features.

As best seen in FIGS. 1 and 3, opening 22 has slot 23 and opening 31 has slot 33. Slots 23 and 33 are positioned so that gravity will not effect the operation of dispenser 1. For example, if dispenser 1 is attached to vertical surface S, then slots 23 and 33 would be in a downward or perpendicular orientation to base 10 (as shown in FIG. 1) but not in an upward orientation to base 10. Alternatively, if dispenser 1 is attached a horizontal surface, then slots 23 and 33 would be in a downward or parallel orientation to base 10 but not in an upward orientation to base 10.

Figure 4:
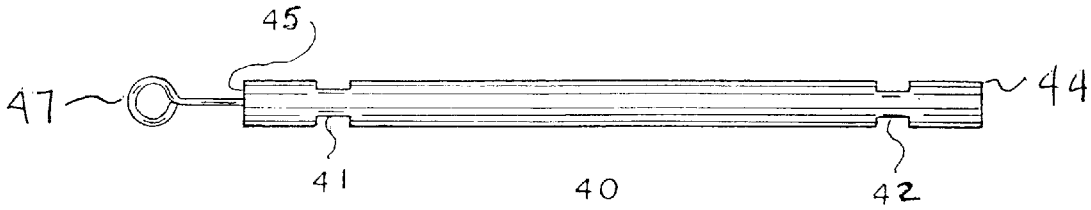
FIG. 4 is a perspective view of the rod.
Figure 5:
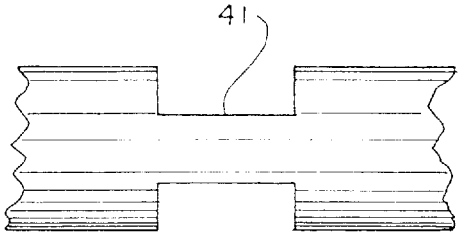
FIG. 5 is a detailed view of one groove on the rod.

Rod 40 has a first end 44 and a second end 45. Ends 44 and 45 of rod 40 are symmetrical. (See FIG. 4.) Rod 40 has groove 41 on end 44 and groove 42 on end 45. (See FIGS. 4 and 5.) Additionally, end 45 of rod 40 may be painted with a fluorescent type paint so that as end 45 is inserted through opening 21 and the interior axial cavity (not shown) of rolled material 2, the user will be able to see rod 40 coming through the interior axial cavity (not shown) of rolled material 2 and opening 31.

Rod 40 may be equipped with handle 47 on end 44 to assist in the insertion of rod 40 through opening 21, the interior axial cavity (not shown) of rolled material 2, and opening 31. Handle 47 assists in the insertion of rod 40 by providing a grasping point for the consumer help guide rod 40 through opening 21, the interior axial cavity (not shown) of rolled material 2, and opening 31.

Rod 40 locks into place by aligning groove 41 with slot 23 and aligning groove 42 with slot 33 (or vice versa, by aligning groove 41 with slot 33 and aligning groove 42 with slot 23). Rod 40 is then pulled toward slots 23 and 33. (See FIG. 1.) To unlock rod 40, rod 40 is pushed from slots 23 and 33 toward openings 21 and 31, respectively.

It should also be noted that end 44 and end 45 of rod 40 are mirror images of each other. Thus, insertion of rod 40 may begin by inserting end 45 through opening 21 of arm 20 (or through opening 31 of arm 30), the interior axial cavity (not shown) of rolled material 2 of rolled material 2 and out opening 31 of arm 30 (or out opening 21 of arm 20). In the opposite direction, insertion of rod 40 may begin by inserting end 44 through opening 21 of arm 20 (or through opening 31 of arm 30) through interior axial cavity (not shown) of rolled material 2, and out opening 31 of arm 30 (or out opening 21 of arm 20). Additionally, fluorescent paint can be added to either end 44 or end 45 of rod 40. Likewise, handle 47 may be attached to either end 44 or end 45 of rod 40.

In a preferred embodiment, arms 20 and 30 are of a sufficient length to allow for the width of rolled material 2 to fit between base 10 and rod 40. It should be noted that arms 20 and 30 can be made of varying lengths to accommodate varying sizes of rolled material 2. FIG. 6 shows dispenser 1 in operation with rolled material 2 on rod 40 and locked into place between arms 20 and 30.

In a preferred embodiment, arm 20 and arm 30 fold down towards base 10 for compact storage and packaging as shown in FIG. 3. Hinges H may be used to allow for arms 20 and 30 to fold down for storage and packaging if necessary.

Dispenser 1 may be made of any material which maintains sufficient strength to withstand daily use. Examples of such materials include plastic, recycled plastic, wood or lightweight metals such as aluminum or stainless steel. If dispenser 1 is made of wood, lightweight metal, or other non-pliable material, then arms 20 and 30 would be attached to base 10 by hinges H as is known.

Having described in detail an embodiment for the present invention, as well as various illustrative alternatives, it is to be appreciated and will be apparent to those of ordinary skill in the art that many modifications and physical changes could be made in the apparatus without altering the inventive concepts and principals embodied therein, and without departing from the true scope of the invention. The present embodiments are therefore to be considered in all respects as illustrative and not restrictive, the scope of the invention being indicated by the appended claims, rather than by the foregoing description, and all changes which come within the meaning and range of equivalency of the claims are therefore to be embraced therein.

I claim:

1. A dispenser for rolled material comprising:

a. a base, having a first end and a second end;

b. a first arm perpendicularly attached near said first end of said base, said first arm having an opening therein;

c. a second arm perpendicularly attached to said second end of said base, said second arm having an opening therein;

d. a first side projection located on said first arm around said opening and facing said second arm;

e. a second side projection located on said second arm around said opening and facing said first arm, whereby said first side projection and said second side projection secure said rolled material between said first arm and said second arm; and, f. an axial rod having a circumferential groove near a first end of said rod and having a circumferential groove near a second opposite end of said rod wherein said first end groove detachably mates with said opening in said first arm and wherein said second end groove detachably mates with said opening in said second arm when said rod is inserted through said openings in said arms for locking said rod in place.

2. The dispenser of claim 1, wherein said opening of said first arm having a first slot and said opening of said second arm having a second slot whereby said rod is locked into place by mating said first end groove with said first slot and mating said second end groove with said second slot.

3. The dispenser of claim 1, wherein said rod further comprises a handle attached to said first end of said rod.

4. The dispenser of claim 1, wherein said rod further comprises a painted end.

5. The dispenser of claim 1, wherein said arms are hingedly attached to said base.

6. A method for dispensing rolled material, comprising the steps of:

a. inserting said rolled material between a first arm and a second arm;

b. securing said rolled material with a first side projection on said first arm and a second side projection on said second arm;

c. inserting a rod through said arms and said rolled material;

d. locking said rod; and e. pulling a selected amount of material from said rolled material.

* * * * *

UNITED STATES PATENT AND TRADEMARK OFFICE

CERTIFICATE OF CORRECTION

PATENT NO. : 5,899,407

DATED : May 4, 1999

INVENTOR(S) : Jospeh S. Hall, III

It is certified that error appears in the above-identified patent and that said Letters Patent is hereby corrected as shown below:

ON THE TITLE PAGE:

Item [76] Inventor's address should be changed to read --

P. O. Box 741313
New Orleans, LA 70174-1313

--.

Signed and Sealed this

Thirtieth Day of November, 1999

*Attest:*

*Attesting Officer*

Q. TODD DICKINSON

*Acting Commissioner of Patents and Trademarks*